United States Patent [19]

Baugh et al.

[11] 4,208,757

[45] Jun. 24, 1980

[54] CHIMNEY FLUE CLEANING APPARATUS

[76] Inventors: John E. Baugh; Patricia A. Baugh, both of 5500 Pierce Park La., Boise, Id. 83703

[21] Appl. No.: 10,386

[22] Filed: Feb. 8, 1979

[51] Int. Cl.[2] ..... F23J 3/00

[52] U.S. Cl. ..... 15/249

[58] Field of Search ..... 15/160, 162, 163, 242, 15/243, 249; 187/3; 312/247

[56] References Cited

U.S. PATENT DOCUMENTS

| | | | |
|---|---|---|---|
| 282,775 | 8/1883 | Resor | 15/249 |
| 497,922 | 5/1893 | Koeberlein | 187/3 |
| 598,672 | 2/1898 | Dunn | 15/163 |
| 1,184,784 | 5/1916 | Steiner | 15/249 |
| 1,297,090 | 3/1919 | Campbell | 15/249 |
| 1,859,166 | 5/1932 | Premo | 15/163 |

*Primary Examiner*—Billy J. Wilhite

*Attorney, Agent, or Firm*—Paul F. Horton

[57] ABSTRACT

Improved chimney flue cleaning apparatus including a chimney cap operable to support a pair of horizontally disposed pulleys; a horizontally disposed drum rotatably mounted in the flue adjacent its lowermost end; a handle for rotating the drum; and an endless cable, with attached brush, threaded about the pulleys and drum. The drum is provided with a single groove helically wound about its exterior surface in threadlike manner. The cable may be wrapped one or more turns about the drum to prevent slippage of the cable. A cable adjustment is provided for controlling cable tension. The brush may be provided with arms having cable engaging apertures for proper centering and stability of the brush as it moves in a vertical upward and downward direction, dependent upon the direction in which the drum is rotated.

2 Claims, 4 Drawing Figures

CHIMNEY FLUE CLEANING APPARATUS

BACKGROUND OF THE INVENTION

1. Field of the Invention

This invention relates, in general, to chimney cleaning apparatus, and in particular to apparatus for cleaning prefabricated chimney flues.

2. Description of the Prior Art

The recent proliferation of airtight woodburning stoves having prefabricated metal chimneys has given rise to significant problems relating to chimney cleaning. Wood fuels, unlike oil, coal, or coke, contain large amounts of sap and wood tars which create creosote as the wood burns. Efficient airtight wood stoves tend to produce large amounts of creosote because of long smoldering, flameless, burning. The metal prefabricated chimneys, which are often used in combination with the airtight wood stoves because they provide efficient heat transfer from the gases going to the chimney to the interior of the house, also provide an effective condensing system for the creosote. Creosote, unlike carbon which also accumulates in all chimneys with all types of fuels, ignites readily and once ignited burns intensely and can in turn ignite the carbon. For these reasons, the proliferation of airtight wood stoves used in combination with metal prefabricated chimneys has led to a great increase of chimney fires in the United States, with over 40,000 reported in 1976 alone.

In addition, it is necessary to clean prefabricated metal chimneys often since the accumulation of creosote and soot on the interior of the chimney significantly decreases the heat conductivity through the chimney and thus reduces the efficiency of the heating system. Thus, there is an inherent need for a chimney cleaning device which is readily available and easy to use so that prefabricated chimneys used with airtight woodburning stoves will be cleaned effectively and often.

Early efforts at providing apparatus for cleaning chimneys are typified by U.S. Pat. No. 598,672 issued to P. C. Dunn. Dunn utilized a cable threaded over a pulley to which a brush was attached. A heavy weight was attached to the bottom of the brush to prevent hangup of the brush during its descent. A horizontal drum, to which one end of the cable was attached, was used to return the brush and weight to the top of the chimney. Because of brush hangup problems, brush centering problems, and accidental detachment of the cable from the takeup spool, further inventions to correct these deficiencies were brought about. J. J. Steiner, U.S. Pat. No. 1,184,784, discloses a chain and sprocket wheel system which, while being effective at preventing brush hangup and cable displacement, presents enormous repair problems because of the extreme number of linkages involved, compounded by expansion contraction problems. Additionally, the chain system is too heavy for the modern prefabricated flues currently in use and cost of such chains is prohibitive. U.S. Pat. No. 1,297,090 issued to C. Campbell and J. A. Cameron discloses a double drummed winch, one drum acting as a takeup spool and the other drum acting as a cable release spool. Unevenness in the takeup windings results in slackness of the cable and ineffective cleaning of the flue. Accidental cable displacement is also a problem with the Campbell device. U.S. Pat. No. 1,859,166 to A. Premro discloses a pulley having retaining fingers to prevent accidental displacement of the cable from the pulley. It has been found that a simple pulley, acting as a rotation drum, does not work satisfactorily because of slippage of the cable upon the pulley with a resultant hangup of the cleaning brush.

SUMMARY OF THE INVENTION

The present invention includes a pulley support; at least one pulley secured to the support; a horizontally disposed drum including a single groove helically wound about the exterior surface of the drum; means for rotating the drum; and an endless cable with attached brush threaded one or more times about the drum and threaded over the pulley for cleaning the interior of a flue. A more complex description of the invention may be found in the appended claims.

It is therefore a general object of the present invention to provide flue cleaning apparatus which is easy to install, light weight, and inexpensive.

It is a further object of the present invention to provide flue cleaning apparatus which prevents hangup of the brush within the flue.

More specifically, it is an object of the present invention to provide flue cleaning apparatus in which an endless cable is wound one or more times around a takeup drum to prevent slippage.

It is also an object of the present invention to provide flue cleaning apparatus having a threaded rotation drum to prevent cable displacement with resultant slackness of the cable.

A still further object of the present invention is to provide flue cleaning apparatus in which the cable is self-cleaned in its contact with the threads of a drum.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
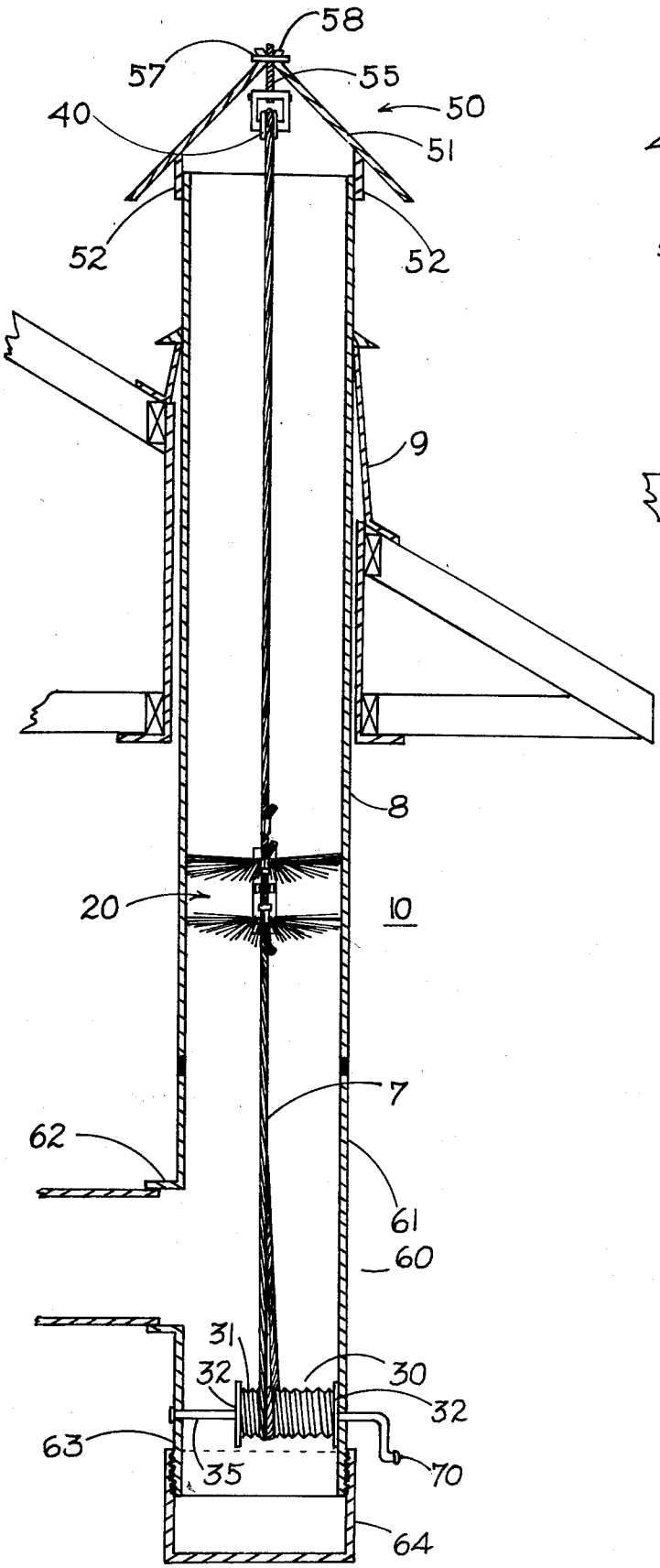
FIG. 1 is a side sectional elevation of a preferred embodiment of the present invention, shown mounted on and within a prefabricated chimney flue.
Figure 2:
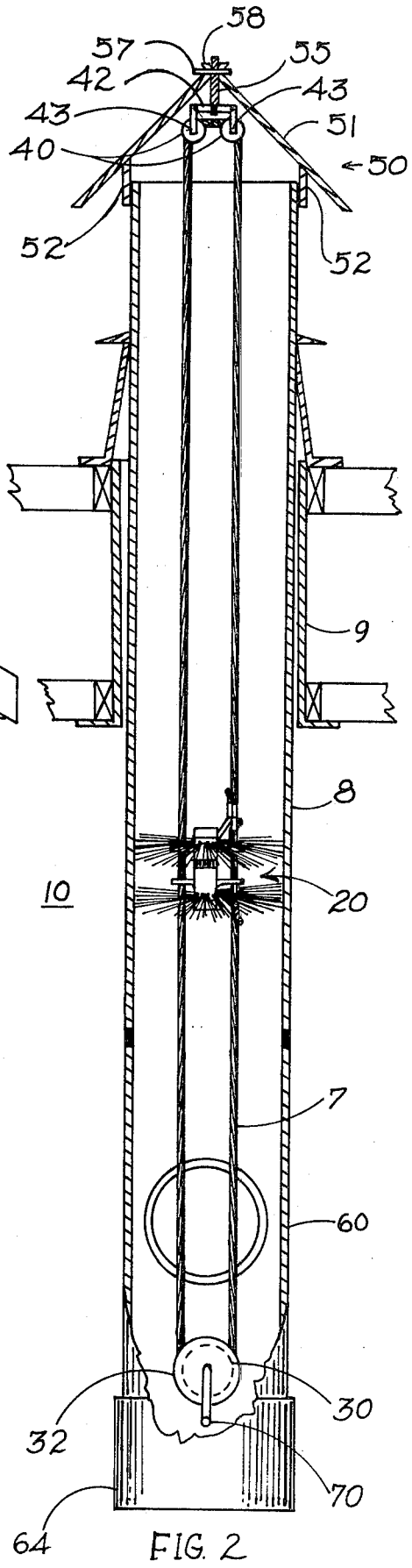
FIG. 2 is a back elevation in partial section of the apparatus shown in FIG. 1.

Referring now to the drawings, and, more particularly to FIGS. 1 & 2, an embodiment to be preferred of chimney flue cleaning apparatus 10 made according to the present invention is disclosed. Flue cleaning apparatus 10 includes pulley support means 50, pulleys 40, drum 30, drum rotation means 70, cable 7, and brush 20.

Pulley support means 50 in the preferred embodiment comprises a chimney cap 51 conical in shape and having downwardly depending flanges 52 which are welded, riveted, or otherwise attached to flue 8 in conventional manner. Supporting structure 50 may be attached to an insulative supporting pipe 9 concentrically surrounding flue 8, as is conventional in the art. Cap 51 is provided with an aperture at its apex into which a bolt 55 is inserted for adjustably suspending a pair of horizontally disposed pulleys 40. Pulleys 40 are spaced with their cable receiving grooves in alignment and are spaced at a distance such that the outer surfaces of grooves of opposing pulleys are at a distance substantially equal to the diameter of drum 30. Pulleys 40 may be connected by a crossbar 42 having depending flanges into which axles 43 of the pulleys are seated. Crossbar 42 serves as a connector to bolt 55. Bolt 55 may be threaded into the crossbar, welded, or otherwise attached. Bolt 55 at its uppermost end is equipped with a washer 57 and a nut 58 for moving pulleys 40 toward or away from cap 51.

Figure 3:
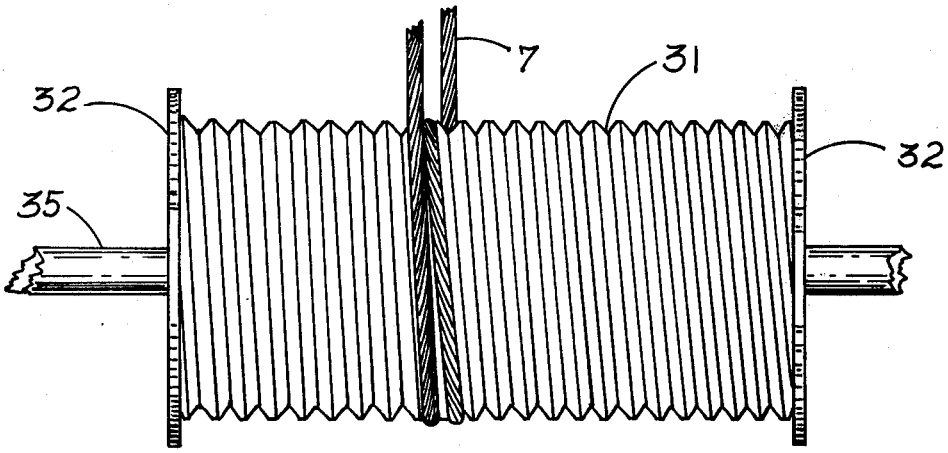
FIG. 3 is an enlarged side elevation of the rotation drum of the present invention.

Drum 30 may be mounted directly into chimney flue 8 or may be mounted into a separate flue extension which attaches to the terminal most lower end of flue 8. In the preferred embodiment the drum is mounted into an extension T-shaped flue 60 having an upper portion 61 attachable to flue 8 in conventional manner, a side portion 62 attachable to a stove in conventional manner, and a downwardly extending lower portion 63 to which a soot cleanout container 64 is removably attached, also by conventional means. Drum 30 is mounted in a horizontal position in the lower portion 63 of flue extension 60. Drum 30, shown to advantage in FIG. 3, includes a central, horizontally disposed threaded pipe section 31 and preferably a pair of vertically extending annular side flanges 32. Pipe section 31 may be made of iron or steel and contains a single threaded groove winding helically about the outer surface of the pipe for a suitable distance, preferably the entire length of the drum. The threaded groove is V-shaped in cross-section and of sufficient depth to receive a steel strand cable 1/16" in diameter. While a square thread may be suitable, the V-shaped thread is preferred to provide maximum contact between cable and drum to prevent slippage. Pipe 31, for best performance, should be equal in diameter to the combined outside diameter of pulleys 40 so that an endless cable wound about pulleys and drum will have vertically parallel ascending and descending portions. Annular flanges 32 are slightly greater in diameter than pipe 31 to prevent detachment of cable 7 from the drum. Drum 30 is attached to extension flue 63 by means of axle 35 which extends concentrically through pipe 31 and through apertures in flanges 32; being journaled for rotation in opposing sides of extension flue 63, in conventional manner. Handle 70 serves as a means for rotating the drum.

Figure 4:
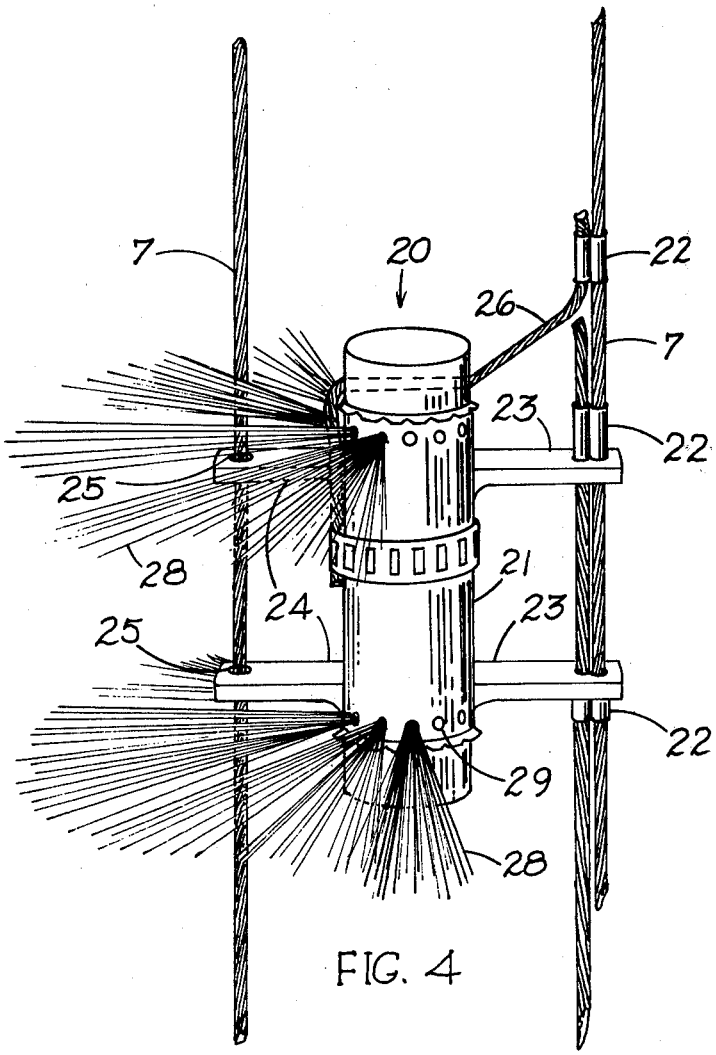
FIG. 4 is an enlarged perspective view of the brush of the present invention as shown attached to a cable.

Referring now to FIG. 4, a brush 20 made according to the present invention is disclosed. Brush 20 in the preferred embodiment includes an elongated cylindrical housing 21 including a multiplicity of flexible steel bristles 28 horizontally and radially extending from apertures 29 surrounding the housing adjacent each end. Brush housing 21 is provided with a pair of vertically spaced horizontally extending arms 23, each arm having vertically aligned cable clamp sleeves 22 at the end thereof. A second pair of horizontally extending vertically spaced arms 24 oppositely disposed from arms 23, each have a vertically aligned aperture 25 for slidingly engaging cable 7 as brush 20 moves upwardly and downwardly. Brush 20 may further include another proximal arm 26 vertically spaced and aligned with arms 23 and located above brush bristles 28 to provide additional stability to the brush as it moves within the flue. Bristles 28 may be attached to housing 21 in any conventional manner.

In setting the apparatus up for operation, cable 7 is threaded through pulleys 40 through apertures 25 of brush 20, is wrapped one or more turns about threaded drum 30 and each end of the cable is then threaded through sleeves 22 of arms 23 and clamped in place to make, effectively, an endless cable. "Endless cables" as used herein and in the claims refers to such cables and not necessarily to cables having no determined end. Cable 7 is then brought into proper tension by tightening nut 58, preferably a wing nut, to draw pulleys 40 into closer apposition to cap 51.

In operation, crank 70 is turned to rotate drum 30 in a desired direction. Cable 7, threaded over drum 30 and pulleys 40, is therefore caused to rotate carrying attached brush 20 upwardly or downwardly, as desired. Bristles 28 of brush 20 contact the interior of the flue to remove deposited soot and creosote particles. Such particles fall downwardly into container 64 where they are conveniently removed. Any particles which adhere to cable 7 are effectively removed as the cable contacts the V-shaped grooves of drum 31. Brush 20 is preferably stored during periods of non-use directly above drum 30 and below the port of side portion 62 to prevent contact between the brush and the exiting flue gases.

Having thus described in detail a preferred embodiment of the present invention, it is to be appreciated and will be apparent to those skilled in the art that many physical changes could be made in the apparatus without altering the inventive concepts and principles embodied therein. The present embodiment is therefore to be considered in all respects as illustrative and not restrictive, the scope of the invention being indicated by the appended claims rather than by the foregoing description and all changes which come within the meaning and range of equivalency of the claims are thereforeto be embraced therein.

I claim:

1. Improved chimney flue cleaning apparatus comprising:

pulley support means engaging the uppermost terminal end of a flue;

a pair of horizontally disposed pulleys;

cable tension adjustment means connecting said pulleys to said support means and operable to adjust the distance between said pulleys and said support means;

a horizontally disposed drum rotatably mounted within the flue, said drum including a single groove, substantially V-shaped in cross-section, helically wound about the exterior of said drum to define a multiplicity of adjacent and horizontally disposed threads;

means external to said flue for rotating said drum;

an endless cable threaded about said pulleys and said drum and operable to move in vertically opposing directions upon rotation of said drum; and a brush including an elongated, substantially cylindrical housing having a multiplicity of radially extending flexible brush bristles adjacent each end of the housing operable to contact the interior surface of the flue and a first pair of horizontally extending, vertically spaced arms, each arm provided with a vertically aligned clamp sleeve adapted to securely engage said cable and a second pair of horizontally extending, vertically spaced arms having vertically aligned apertures for slidingly engaging an opposing portion of said cable, said second pair of arms oppositely disposed from said first pair of arms.

2. Improved chimney flue cleaning apparatus comprising:

pulley support means engaging the uppermost terminal end of a flue;

at least one pulley secured to said support means;

a horizontally disposed drum rotatably mounted within the flue, said drum including a single groove helically wound about the exterior surface of said drum in thread-like manner;

means for rotating said drum externally to the flue;

an endless cable threaded in the groove of said drum and about said pulley and operable to move in vertically opposing directions upon rotation of said drum; and a brush adapted to scrape the interior walls of the flue and secured to said cable, said brush including an elongated, substantially cylindrical housing having a multiplicity of radially extending flexible brush bristles adjacent each end of the housing operable to contact the interior surface of the flue, a first pair of horizontally extending vertically spaced arms, each arm provided with a vertically aligned clamp sleeve adapted to securely engage said cable, and a second pair of horizontally extending vertically spaced arms having vertically aligned apertures for slidingly engaging said cable, said second pair of arms oppositely disposed from said first pair of arms.

* * * * *